US008311830B2

(12) United States Patent
Campbell et al.

(10) Patent No.: US 8,311,830 B2
(45) **Date of Patent: *Nov. 13, 2012**

(54) SYSTEM AND METHOD FOR CLIENT VOICE BUILDING

(75) Inventors: Craig F. Campbell, Pittsburgh, PA (US); Kevin A. Lenzo, Pittsburgh, PA (US); Alexandre D. Cox, Pittsburgh, PA (US)

(73) Assignee: Cepstral, LLC, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/311,867

(22) Filed: Dec. 6, 2011

(65) Prior Publication Data

US 2012/0116776 A1 May 10, 2012

Related U.S. Application Data

(63) Continuation of application No. 12/129,171, filed on May 29, 2008, now Pat. No. 8,086,457.

(60) Provisional application No. 60/940,779, filed on May 30, 2007, provisional application No. 61/020,775, filed on Jan. 14, 2008.

(51) Int. Cl.
*G10L 13/08* (2006.01)

(52) U.S. Cl. ..... 704/260; 704/258; 704/E13.002; 704/E13.004

(58) Field of Classification Search ..... 704/258, 704/260, E13.001, E13.002, E13.005, E13.006, 704/E13.008, E13.009, E13.01
See application file for complete search history.

(56) References Cited

U.S. PATENT DOCUMENTS

| | | | |
|---|---|---|---|
| 5,737,725 | A | 4/1998 | Case |
| 5,758,323 | A | 5/1998 | Case |
| 5,832,062 | A | 11/1998 | Drake |
| 6,604,077 | B2 | 8/2003 | Dragosh |
| 6,625,576 | B2 | 9/2003 | Kochanski et al. |
| 6,810,379 | B1 | 10/2004 | Vermeulen et al. |
| 6,963,838 | B1 | 11/2005 | Christfort |
| 7,013,275 | B2 | 3/2006 | Arnold et al. |
| 7,027,568 | B1 | 4/2006 | Simpson et al. |
| 7,099,826 | B2 | 8/2006 | Akabane |
| 7,305,340 | B1 | 12/2007 | Rosen et al. |
| 7,313,528 | B1 | 12/2007 | Miller |
| 7,315,820 | B1 | 1/2008 | Munns |
| 7,711,562 | B1 | 5/2010 | Davis et al. |

(Continued)

OTHER PUBLICATIONS

Bunnell et al. "Automatic Personal Synthetic Voice Construction". Interspeech 2005, Sep. 4-8, Lisbon, Portugal.*

*Primary Examiner* — Jesse Pullias
(74) *Attorney, Agent, or Firm* — McKay & Associates, P.C.

(57) ABSTRACT

Provided is a system and method for building and managing a customized voice of an end-user, comprising the steps of designing a set of prompts for collection from the user, wherein the prompts are selected from both an analysis tool and by the user's own choosing to capture voice characteristics unique to the user. The prompts are delivered to the user over a network to allow the user to save a user recording on a server of a service provider. This recording is then retrieved and stored on the server and then set up on the server to build a voice database using text-to-speech synthesis tools. A graphical interface allows the user to continuously refine the data file to improve the voice and customize parameter and configuration settings, thereby forming a customized voice database which can be deployed or accessed.

5 Claims, 9 Drawing Sheets

U.S. PATENT DOCUMENTS

| | | | |
|---|---|---|---|
| 8,086,457 | B2 | 12/2011 | Campbell et al. |
| 2002/0049594 | A1 | 4/2002 | Moore et al. |
| 2003/0009340 | A1 | 1/2003 | Hayashi et al. |
| 2003/0154081 | A1 | 8/2003 | Chu et al. |
| 2003/0187658 | A1 | 10/2003 | Selin et al. |
| 2003/0200094 | A1 | 10/2003 | Gupta et al. |
| 2003/0229494 | A1 | 12/2003 | Rutten et al. |
| 2004/0006471 | A1 | 1/2004 | Chiu |
| 2004/0064374 | A1 | 4/2004 | Cho |
| 2004/0098266 | A1 | 5/2004 | Hughes et al. |
| 2004/0111271 | A1 | 6/2004 | Tischer |
| 2004/0225501 | A1 | 11/2004 | Cutaia |
| 2006/0095265 | A1 | 5/2006 | Chu et al. |
| 2008/0034056 | A1 | 2/2008 | Renger et al. |
| 2008/0040328 | A1 | 2/2008 | Verosub |

* cited by examiner ( Home | Create | Upload | Import | Manage )

Voice: cepstral_us_whispery [Refresh] 26

Data

Name: Whispery
Vendor: cepstral
Age: 0
[Save]

Lang: US English
Prompts: 77
Waves: 77
Utt Files: 77
PM Files: 77

- Upload new data
- Import uploaded data
- Edit User Lexicon
- Data Removal

Synthesis

No Builds Found [Create WAV]

Packages

Builds:
No builds found.
Other Packages:
cepstral_us_whispery_full.tar.bz2 ( 9.84 MB )
cepstral_us_whispery_project.tar.bz2 ( 221.26 KB )

Builder

| | | | |
|---|---|---|---|
| Build: | ○ None | ◉ Full | |
| Output: | ☐ 8k | ☐ 11k | ☑ 16k |
| Labeling: | ◉ None | ○ Fast | ○ Full |
| Package: | ☑ Build | ☐ Waves | ☐ Full |
| Other: | ☑ Clean | ☐ Cluster | ☐ Prune |

Name: Builder's username here. [Build!]

Queue Status: Monday, 12:37:35 PM [Refresh]

Active Builds:

cepstral_us_whispery | clean | updatelf | mcep | dlist | clunits | build | check | tidy | buildpkg | daily | sMaw | pack | sendmail ( Home | Create | Upload | Import | Manage )

FIG. 6

Voice Manager 28 ( Home | Create | Upload | Import | Manage )

Voice: cepstral_us_david [Refresh]

Data Removal [Done]

Entry Name: 397
Data Types:
Prompt-lines: ☑
Utterances: ☑
Pitchmarks: ☐ [Search]

This data will be permanently deleted upon confirmation:

| | |
|---|---|
| **cepword_01397:** prompt utterance | **cla3103976:** prompt utterance |
| **cla3130397:** prompt utterance | **cla3139738:** prompt utterance |
| **cla3140397:** prompt utterance | **cla323979:** prompt utterance |
| **cla397261:** prompt utterance | **cla397303:** prompt utterance |
| **cla397346:** prompt utterance | **clb397303:** prompt utterance |

[CONFIRM DELETION]

Queue Status: Monday, 01:04:33 PM [Refresh]

Recent Builds:
cepstral_us_whispery :: Finished @ 12:38

( Home | Create | Upload | Import | Manage )

FIG. 8

SYSTEM AND METHOD FOR CLIENT VOICE BUILDING

The instant application is a continuation of application Ser. No. 12/129,171 filed May 29, 2008 now U.S. Pat. No. 8,086,457, which further claims benefit of provisional application Ser. No. 60/940,779, filed May 30, 2007 and provisional application Ser. No. 61/020,775, filed Jan. 14, 2008.

BACKGROUND

1. Field of the Invention

The present invention relates to text-to-speech systems and methods. Although phoneme creation and implementation has been used to create speech from text input as is known in the art, in the instant system and method a client/end-user is given the opportunity to build and upload data and recordings onto a web-based system that allows them to build and manage their voice for use in widespread applications.

2. Description of the Related Art

A speech synthesizer may be described as three primary components: an engine, a language component, and a voice database. The engine is what runs the synthesis pipeline using the language resource to convert text into an internal specification that may be rendered using the voice database. The language component contains information about how to turn text into parts of speech and the base units of speech (phonemes), what script encodings are acceptable, how to process symbols, and how to structure the delivery of speech. The engine uses the phonemic output from the language component to optimize which audio units (from the voice database), representing the range of phonemes, best work for this text. The units are then retrieved from the voice database and combined to create the audio of speech.

Most deployments of text-to-speech occur in a single computer or in a cluster. In these deployments the text and text-to-speech system reside on the same system. On major telephony systems the text-to-speech system may reside on a separate system from the text, but all within the same local area network (LAN) and in fact are tightly coupled. The difference between how a consumer and telephony system function is that for the consumer, the resulting audio is listened to on the system that did the synthesis. On a telephony system, the audio is distributed over an outside network (either wide area network or telephone system) to the listener.

For end-users of text-to-speech software the software typically (historically) resides on one of their computers. The two most commonly used computer systems for consumers provide a vendor independent API for text-to-speech. On Windows it is cabled SAPI and on a Macintosh it is called Apple Speech Manager. These API layers allow all text-to-speech vendors (software and) voice databases to be used interchangeably on the user's computer. These interfaces provide a common abstraction for all vendors' locally installed software.

Client/Server architecture where the text, synthesis and audio are not tightly connected exist but are rare. For example, U.S. Pat. No. 6,625,576 describes a method and apparatus for performing text-to-speech conversion wherein a client/server environment partitions an otherwise conventional text-to-speech conversion algorithm. The text analysis portion of the algorithm is executed exclusively on a server while the speech synthesis portion is executed exclusively on a client which may be associated therewith.

U.S. Pat. No. 6,604,077 shows a system and method of operating an automatic speech recognition and text-to-speech service using a client-server architecture. Text-to-speech services are accessible at a client location remote from the main, automatic speech recognition engine. U.S. Pat. No. 7,313,528 teaches a text-to-speech streaming data output to an end user using a distributed network system. The TTS server parses raw website data and converts the data to audible speech.

These client/server systems all focus on synthesis and thus the relationship (proximity) of text, engine and audio output.

The engine and language front-end are constructed from software. The voice database is built from recorded speech. In the process to build a voice database a voice talent reads predetermined text. These readings are recorded. After the recording session(s) the recordings are put through a process of decomposition where each phoneme is identified and labeled (plus some additional information). These units are then put into a database for retrieval during synthesis.

While the previous paragraph makes this process appear simple it is in fact very complex and difficult. Due to the complexity this process is typically very expensive. This has the direct result of Text-to-Speech vendors (companies that produce voice databases) producing only one or two voices in each language they support. The voices are chosen for their mass appeal and to minimize risk of market acceptance. As an example, not including the Company submitting this patent, there are approximately 10 high quality U.S. English commercially available voice databases from the six (or so) TTS vendors. Each of these voices are very similar in their characteristics and almost unidentifiable from vendor to vendor.

A complete, open source set of tools and documentation for producing new voices and languages is available at the website for "festvox" for public consumption. These tools allow one to build their own voice. There have also been other attempts made to allow end-users to build voices. Due to the complexity involved the results are rarely good enough to be considered commercially viable. It also requires a large investment of time to acquire the knowledge on how to run these systems.

Most users that would like to build their own voice do not want to use it in one of the traditional TTS markets. The traditional markets have been telephone systems and education. These domains have been satisfied with the limited selection and similarity of each vendor's offerings. Note that accessibility is one of the traditional markets and is one market where users would prefer to have their own voice or one they closely identify with.

There is a burgeoning demand for variety. As an example, the entertainment industry is not interested in the bland, robotic voice of telephony systems. There are thousands of "interesting" voices that might serve different markets, and such distinction can never be created by one entity or program. The entertainment industry can be thought to include (but not limited to) avatar based messaging services, and online games. There is also a growing demand for personalizing information as it is presented. A greater variety of voices available allows for more choice.

Phoneme sequence assemblage (as occurs during speech recognition and during the process of voice database building) done in different environments can lead to many different applications. Because open source tools are not capable of providing communication or storage platforms and certain online environments have many other limitations including end quality, stability, and graphical interfaces, it is outside anybody's internal ability to ever achieve such a scale of capturing literally all voice characteristics. The most practical way to build one's audible voice into a voice database and be able to apply that voice to literally any online environment is to give as many voice-building tools to the end user as possible and coordinate and instruct the building process remotely.

There is need then for a network based voice-building process which provides an abundance of tools and enhances the client's role. With such end-user interaction, the built voices can be highly customized to a desired level of the end-user's choosing, and of extremely realistic quality, extending the applicability of voices to targeted areas.

SUMMARY

The present system and method commercially gives the voice-building tools directly to the client and allows the end-user to create voices of their own, and a business model is created to offer the voice building phase as a service and continue regular runtime engine licensing for completed voices which are deployed. For instance, the end-user has complete access to all intermediate data and retains control over all intellectual property associated with the voice. As well, in the end, end-users receive a voice capable of running on the server's professional, scalable, and robust, software engine. As will be further described, by providing the actual voice-building tools to the end-user, many commercial advantages can be realized as the customer captures or "banks" their own voice, allowing for the creation and use of literally millions of voices in a voice marketplace and social network environment.

Accordingly, the present invention comprehends a system and method for building and managing a customized voice of an end-user for a target comprising the steps of designing a set of prompts for collection from the user, wherein the prompts are selected from both an analysis tool and by the user's own choosing to capture voice characteristics unique to the user. The prompts are delivered to the user over a network to allow the user to save a recording to a server of a service provider. This recording is then retrieved and stored on the server and then set up on the server to build a voice database using text-to-speech synthesis tools. A graphical interface allows the client to continuously refine the voice database to improve the quality and customize parameter and configuration settings. This customized voice database is then deployed, wherein the destination is the service provider, a customer of the service provider, or an alternative platform managed by the end-user.

The system and method further comprehends providing the end-user with workshop space on the server such that the user can post blogs and receive comments from other users concerning their voice database(s); analyzing the voice to provide suggestions to the owning user to improve the quality of the voice; providing ratings for the voice; listing the voice for sale (and general use) on the server of the service provider for purchase by the customers of the service provider; providing sales rankings for the voice; as well as provide other features available as a result of the end-user's ability to enhance and customize their voice(s).

BRIEF DESCRIPTION OF THE DRAWINGS

FIG. 6 represents an example graphical client interface of the voice manager.

FIG. 8 represents an example graphical client interface of the data removal tool.

DETAILED DESCRIPTION OF THE PREFERRED EMBODIMENT

The flow charts and/or sections thereof represent a method with logic or program flow that can be executed by a specialized device or a computer and/or implemented on computer readable media or the like tangibly embodying the program of instructions. The executions are typically performed on a computer or specialized device as part of a global communications network such as the Internet. For example, a computer typically has a web browser installed for allowing the viewing of information retrieved via a network on the display device. A network may also be construed as a local, Ethernet connection or a global digital/broadband or wireless network or the like. The specialized device may include any device having circuitry or be a hand-held device, including but not limited to a personal digital assistant (PDA). Accordingly, multiple modes of implementation are possible and "system" as defined herein covers these multiple modes.

Figure 1:
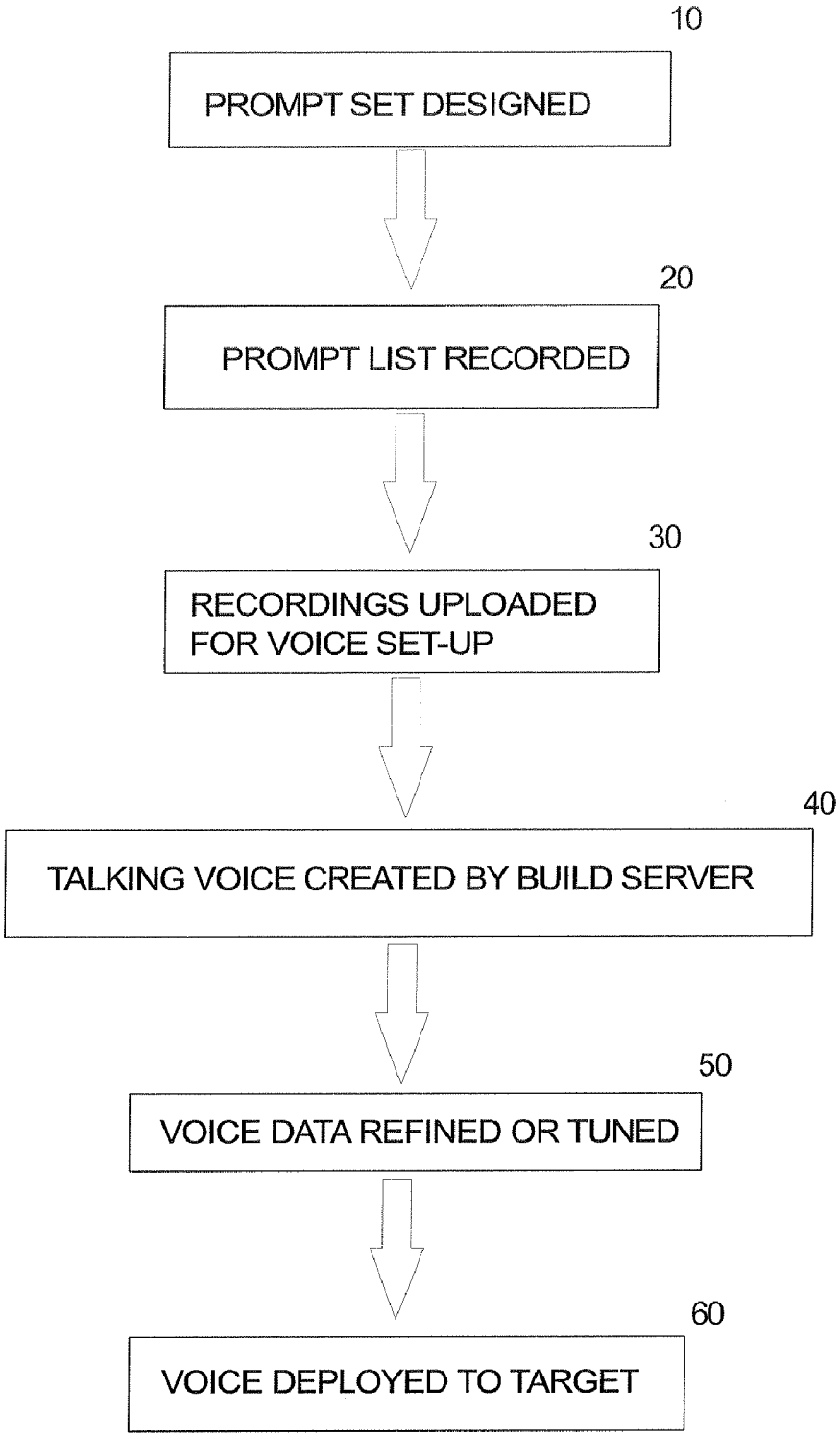
FIG. 1 is a flow diagram representing the overall process flow.
Figure 2:
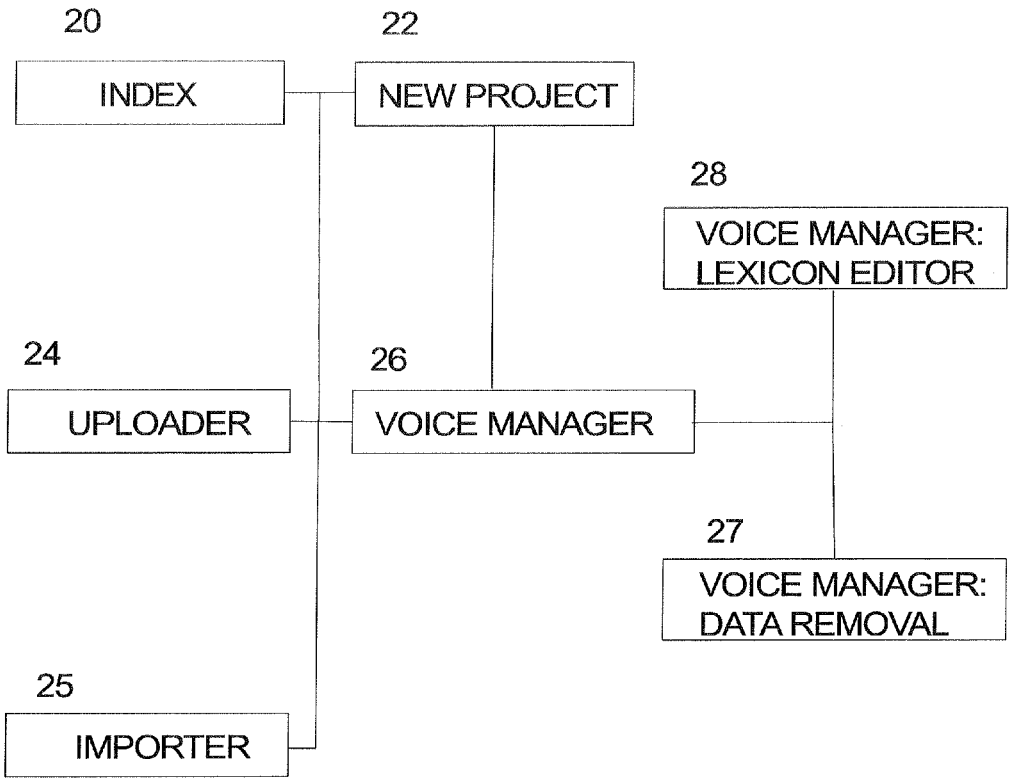
FIG. 2 is a flow diagram representing an example sitemap of the end-user interfaces further shown in FIGS. 3-9.
Figure 3:
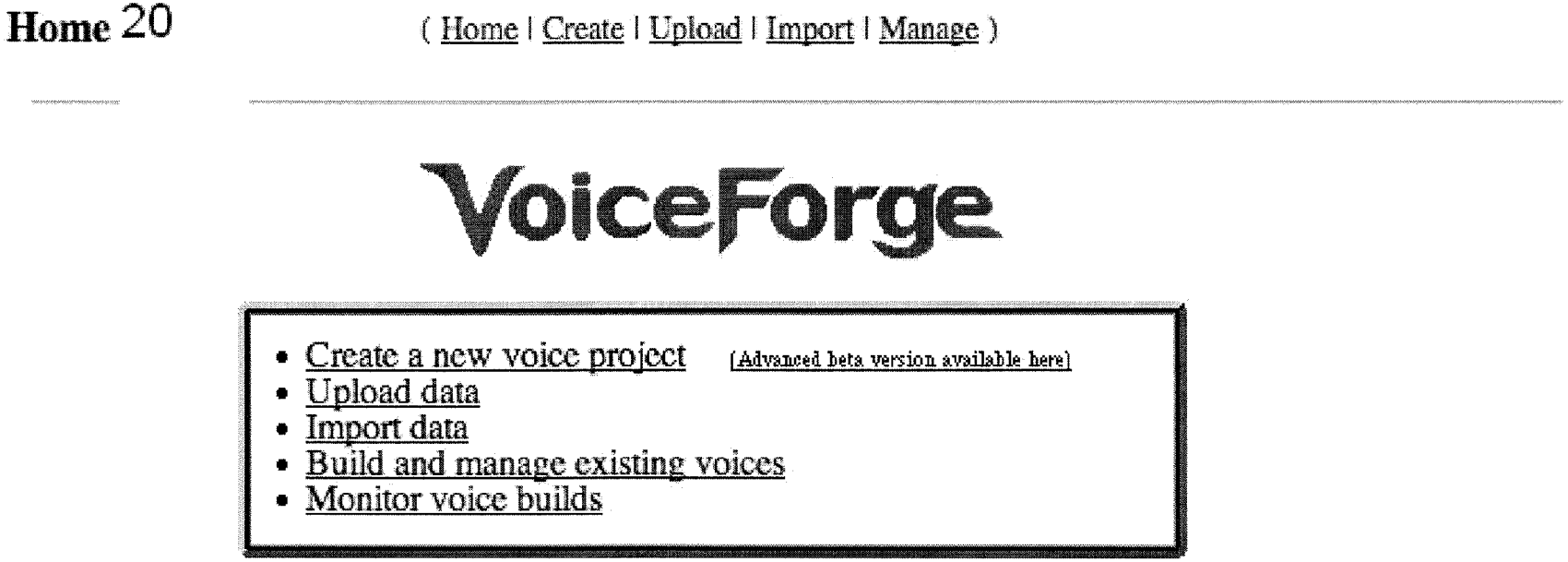
FIG. 3 represents an example graphical client interface of the home page or index.
Figure 4:
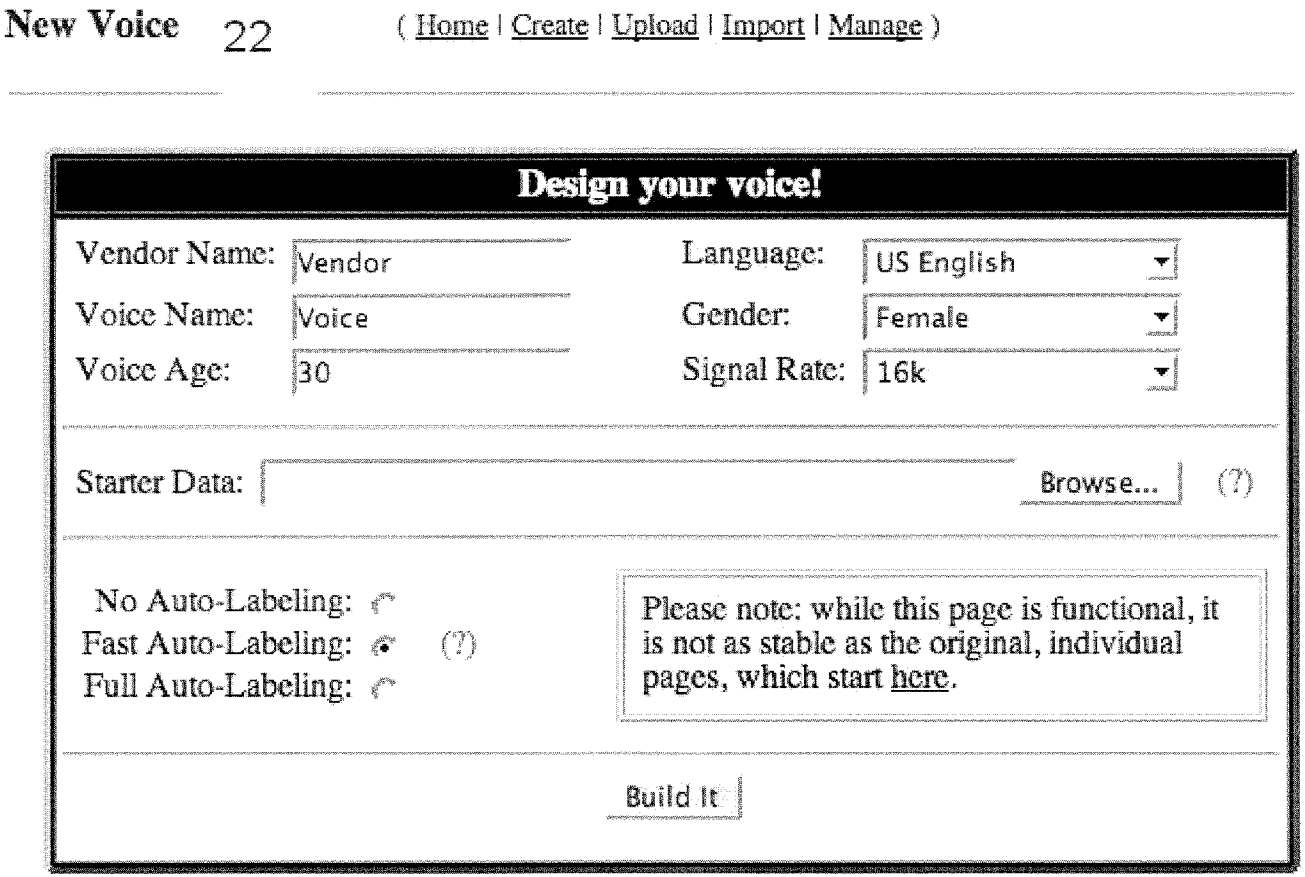
FIG. 4 represents an example graphical client interface of the new voice project initiation.
Figure 5:
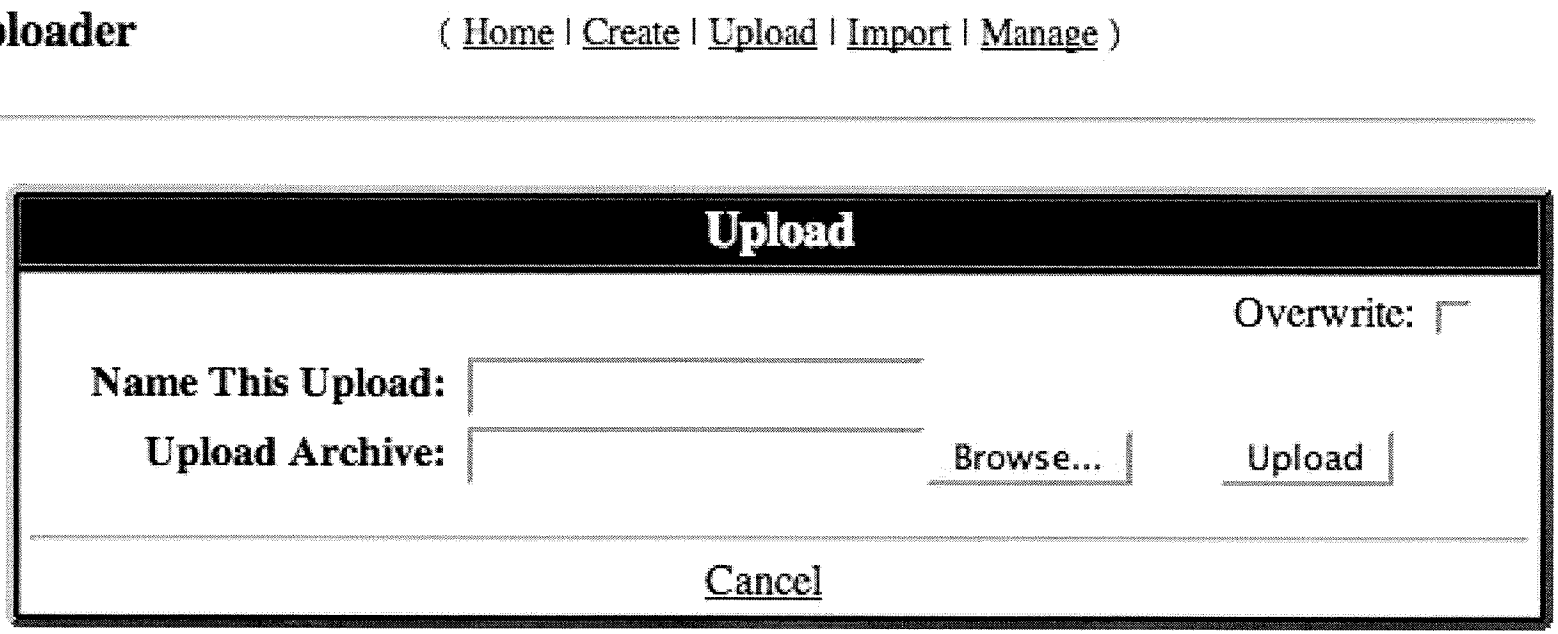
FIG. 5 represents an example graphical client interface of the uploader.
Figure 7:
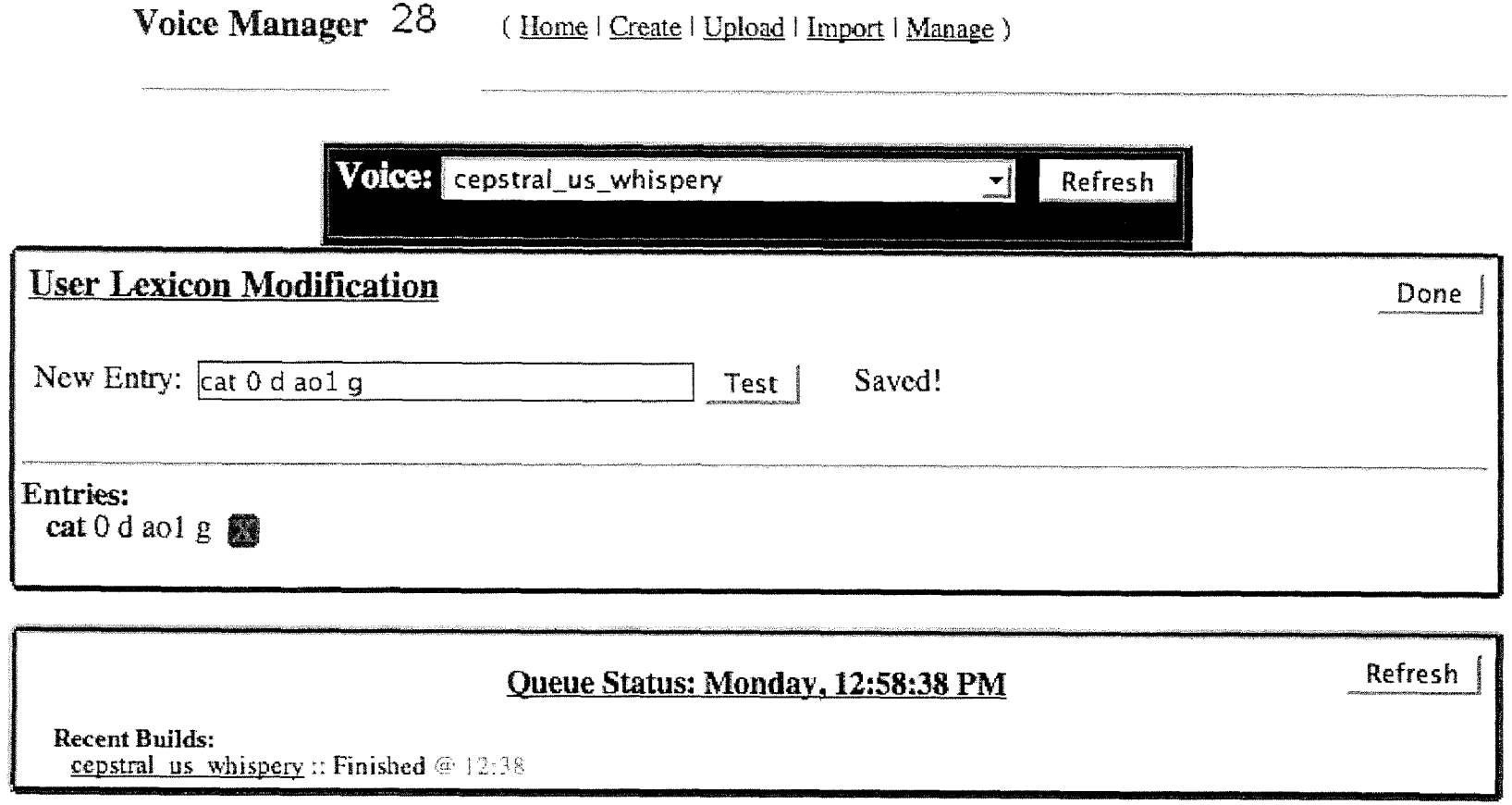
FIG. 7 represents an example graphical client interface of the lexicon editor.
Figure 9:
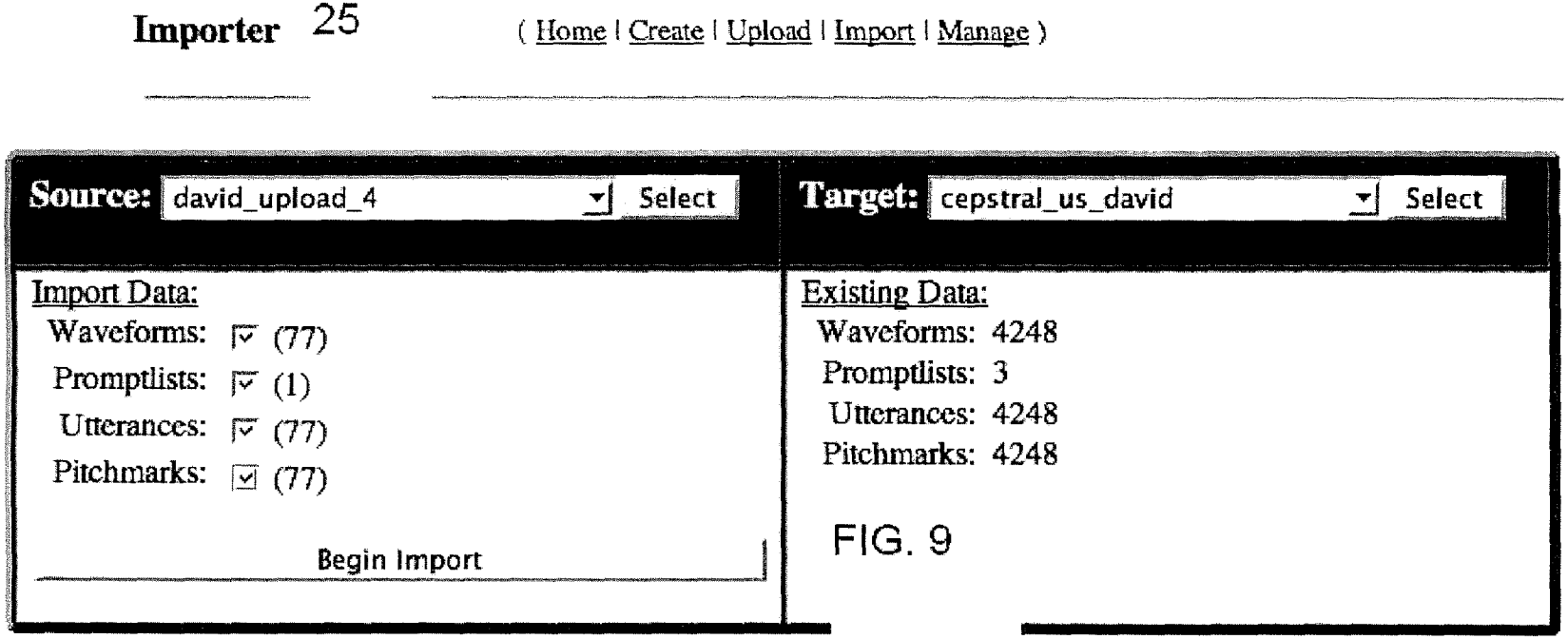
FIG. 9 represents an example graphical client interface of the importer.

With reference generally then to FIGS. 1-10, a set of recordings (or prompts) is designed for collection 10 from a client or end-user. Analysis tools are used to evaluate and/or propose optimized recording sets based on several linguistic features including phonemic, syllabic, stress, and phrase position contexts. Out of the prompt architecting process a set (e.g.: one thousand) of phonetically-rich utterances are designed for recordation in order to cover an inventory of language sounds and configurations an individual speaker produces during regular speech, and a number of sentences of the end-user's own choosing can be added, so that key catch-phrases or sayings of the character may come out especially well. Critical to this step is that the prompts are selected not just by the service provider's analysis tool (server-based) but further by the client's own choosing to capture voice characteristics unique to the client/end-user.

The prompts are delivered to the client over a network to allow the client to save the recording. The end-user will make an audio recording for each utterance. The recordings are sent in by the user so that a voice database can be created. In a preferred embodiment, recordings are made over the Internet so that the client could actually record through a webpage and the data is filtered and saved through to the provider server. As output, the recordings take the form of a .wav file, which can be converted to text and vise-versa. Accordingly, there is server space for the client's recording and voice database to reside.

The recordings with text are all paired or cross-checked to a prompt list, which is created in anticipation of delivery of the recordings by the client 20. In the prompt list, each sentence is given a unique identifier so that it can be related to the specific recording. The recordings should be in as good conditions as possible, recording studio, quiet, 44.1 or 48 kHz sampling rates, 16 bit or better, with no signal modification—no compression, no filtering. Audio should be clean, no clipping, with good overall signal strength. The voice-talent or client should speak, in a regular manner, even it representing a personality, so that the synthesis can represent it consistently. Additional guidelines may be given within a particular type of a service agreement with the client.

The recordings are uploaded to the provider of the service, also termed herein the provider server, using a web interface, and the initial process of the voice build is run (termed set up) 30. The set up by the provider will be performed at a fee. The client recording is set up on the server to build a talking voice using text-to-speech synthesis tools. This includes audio preprocessing, linguistic segmentation, annotation of the speech sounds in the corpus, estimation of pitch marks for pitch-synchronous synthesis, and other operations. Importantly, the provider creates new intermediate metadata, such as the utterance and pitch mark annotations that the end-user may retrieve in full at any time. Their format is consistent with an academic standard. After set up 30, the provider server returns the contents of the build directory as needed to create a voice that will talk 40, which is a data file the client may continuously retrieve over the network.

Once a voice is set up 30 from above, the end-user has full access to build the voice 40 as frequently as they choose. The Build server is typically triggered every evening or more frequently so that any batch of changes (from the Refine tools below) can be incorporated into the voice. The Build server creates a voice, which can run on any desired platform (Mac OS X, Linux, Windows, WinCE, Solaris, etc), on mobile devices, desktops, and telephony applications. This is exposed through a web service, which allows parameter and configuration settings determined in part by the end-user. Thus, the built voice is a data file which then runs on the platform or engine.

The intermediate data may be refined 50 or tuned, in order to improve the voice. It may also be left "as is" (from the recording session). The current state of the art in automated annotation is not perfect, and hand correction of the utterance annotations, pitch marks, text processing and other assumptions made in the automated conversion process leads to higher quality overall. Tools are utilized for working at this level which can be exported to the end-user location, allowing the end-user to tune and correct the voices on their own at their site. These tools provide a graphical interface to allow the user to modify the unit designations and boundaries. For example, to add or edit custom pronunciation of specific words the client can create (or edit) a lexicon.txt file found in each voice's data directory (see FIG. 7 for example).

Once a voice is finished, or a beta version is deemed fit to enter public life, the voice can be exposed or deployed 60 using the provider's runtime engine. The voice, once deemed finished, will be accessible to any application that uses an API to the voices in the provider's voice bank. Accordingly, the customized voice can be deployed 60 to a target, wherein the target is the service provider, a customer of the service provider, or an alternative platform managed by the client such that the client can apply the customized voice from the voice database to any online environment. As defined herein then "any" online environment as defined herein means including but not limited to a general information website, a blog, a chat site, social networking site, virtual world, Internet connected toy, Wi-Fi enabled electronic device, or an integrated voice response system (IVR).

As above, although voices can be banked and delivered by way of an online platform, in a further embodiment local access to all voice database inventory can be given to an end user. As termed herein proxy program, this program can be installed on an end user's machine. The proxy program abstracts the location of the engine and voice database. With such an implementation, a voice database that resides on a remote server appears and functions the same as an engine and voice database that are installed on the local system. In fact, in the present embodiment, the two different deployments are indistinguishable to the user. That is, that the voices stored on the Internet appear to be installed permanently on the local machine. The proxy program provides the full functionality of a local speech engine from a remote service. This results in the user being able to leverage all voices in all existing or legacy applications even though such application may have no knowledge of the voice database or engine residence. Users can select the voices they want and which voice that they wish to have installed locally as the fall-back voice for offline use. This dual use gives the system the smallest footprint, cheapest price, and biggest value in terms of flexibility, disk space, and variety.

In addition to the voice database being banked for use by the user who created the voice, the user will also be able to make it visible to all users on the servers. Such client interaction allows for social networking aspects of "shared" voices and virtual marketplaces. For instance, the client can tie their voice into what they have already posted on myspace.com or other platforms. Alternatively, the user can utilize the provider's services. In using the provider services, the following methodologies result.

In one embodiment, termed herein a mass-user version, the mass-user version resides on the provider server. The provider server is accessed through a series of interactive webpages. See FIGS. 2-9 for example, which in simplified form, depicts one type of layout possible which would allow the end-user to access all of the features, including an index 20, a new project 22, an uploader 24, an importer 25, and a voice manager 26 having the appropriate editor 28 and data removal 27 tools. The general method for building a voice will be similar to the above-mentioned version, in that by starting a new project (FIG. 3) a user will create (and initially receive) a prompt list, record, that text, and submit the paired data to the server, which then provides a text to speech voice based on the submitted data.

A home page or index 20 serves primarily as a gateway for users. It provides quick links to the various services available on the site. It further allows the user or client to create an account for designing their voice as part of their project 22 with which to access features that require an account. It can contain a welcome section familiarizing new users with the provider services, and it contains news about the provider services—including software updates, and various fun-facts. Finally, the home page can provide a list of the most listened to, top selling, and best user-rated voices. The layout of the quick links, header, and login/logoff section preferably remains the same on all of the pages with the intent of maintaining a stable supporting layout. The concept is to provide the client with workshop space on the server.

The 'my workshop' page or voice manager 26 provides the user with their own 'space' on the provider service. It has standard blogging functionality, in that the user can post blogs and be visited by and receive comments from other users. This page allows users to create their own text-to-speech (TTS) voices, via waves and text transmitted over the web. It further shows users voice database analysis 28, including phonetic coverage, audio consistency (volume, pitch, etc), and listening evaluation results. It can show users by-voice ratings (several in groups of: today, this week, total), including number of listeners, number of sales, and ratings. The database an analysis and ratings are displayed in a format that encourages growth, and suggestions can be provided to improve the voice. A prompt suggestion tool is provided that uses existing analysis to determine the most beneficial text to suggest, driven by a massive prompt database that contains pre-determined linguistic feature data and prioritized ordering.

In the voice marketplace embodiment, settings for the user's voices are available, and a user can set up a voice database for sale, and manage pricing. Marketplace-User's voices will be sold here, as installers, and streaming synthesizer web plugins. For instance, if a customer voice is created and built and stored on the provider server, it could be made available for sale to an interested party. When the voice is purchased by a licensee, such as a video game software provider or series company, the voice creator and the provider, server can retain a royalty in light of the voice marketplace being established. User's can quick-configure their pricing and availability of their voices, and user's voices can be rated and listened to here, with a dynamic demo that allow potential buyers to type in the text they want to hear. The audio is heavily 'watermarked' to avoid exploitation by listeners. Customers are able to perform reverse searches for voices that will perform well on customer-desired text. This is performed via comparing the desired-text-relevant portion of the pre-generated linguistic analysis data of all user's voices. Customers can browse through the voices based on different search criteria and view user's public workshops.

Further, as part of the builder forum voice builders can "talk shop". A "Requests" forum is where would-be buyers can request voice characters and communicate with builds. It further acts as a support forum where both users and employees can share tips and help troubleshoot problems.

We claim:

1. A system for building and managing a customized voice of a client for a target, comprising:

a set of prompts for collection from said client, said prompts being selectable from both an analysis tool and by the client's own choosing, wherein a number of sentences of the client's own choosing can be added to said set of prompts for selection by said client to capture voice characteristics unique to said client;

means for delivering said prompts to said client over a network to allow said client to save a client recording on a server of a service provider;

means for storing said client recording on said server;

means for setting up said client recording on said server to build a talking voice using text-to-speech synthesis tools, wherein said talking voice is a data file built into a voice database which said client may retrieve over said network and continuously access;

means for hand-correcting said data file to improve said data file wherein annotations, pitch marks, and text processing can be corrected by said service provider;

means for allowing said client to refine said data file to improve said talking voice and customize parameter and configuration settings, wherein said client can add or edit custom pronunciation of specific words, thereby forming a customized voice; and, means for deploying said customized voice to a target, wherein said target is said service provider, a customer of said service provider, or an alternative platform managed by said client such that said client can apply said customized voice from said voice database to any online environment.

2. The system of claim 1, further comprising workshop space on said server such that said client can post blogs and receive comments from other users concerning said talking voice.

3. The system of claim 1, further comprising a forum for providing suggestions to said client to improve the quality of said talking voice.

4. The system of claim 1, further comprising a reverse search engine for allowing said customer to perform reverse searches for voices that will perform ell on customer-desired text.

5. The system of claim 1, further comprising a proxy program for local access to said customize voice, wherein said program is installed on a machine of said client and said proxy program allows said voice database to appear and function the same on said machine of said client as if it were on said server of said service provider.

* * * * *